United States Patent [19]

Haessler et al.

[11] Patent Number: 4,542,266

[45] Date of Patent: Sep. 17, 1985

[54] CONTACT ARRANGEMENT FOR VACUUM SWITCHES

[75] Inventors: Heinrich Haessler; Wilfried Kuhl, both of Wendelstein, Fed. Rep. of Germany

[73] Assignee: Siemens Aktiengesellschaft, Berlin and Munich, Fed. Rep. of Germany

[21] Appl. No.: 572,725

[22] Filed: Jan. 20, 1984

[30] Foreign Application Priority Data

Jan. 24, 1983 [DE] Fed. Rep. of Germany ..... 3302201

[51] Int. Cl.[4] ..... H01H 33/66

[52] U.S. Cl. ..... 200/144 B; 200/275

[58] Field of Search ..... 200/144 B, 275, 279

[56] References Cited

U.S. PATENT DOCUMENTS 3,996,437 12/1976 Selzer ..... 200/144 B
4,249,050 2/1981 Okumura ..... 200/144 B
4,431,885 2/1984 Sakuma et al. ..... 200/144 B

FOREIGN PATENT DOCUMENTS 2546376 6/1976 Fed. Rep. of Germany .
2925189 2/1981 Fed. Rep. of Germany .

*Primary Examiner*—Robert S. Macon
*Attorney, Agent, or Firm*—John Francis Moran

[57] ABSTRACT

Contact arrangement for vacuum switch in which one of two contacts is movable relative to the other in the axial direction of the contacts and is designed as a recessed contact. According to the invention, a condensation plate with a diameter greater than the inside diameter at the rim of the recessed contact is provided between the other contact and its current lead. The sidewall of the recessed contact forms a guide ring for the metal vapor, a substantial part of which condenses on the condensation plate.

14 Claims, 2 Drawing Figures

CONTACT ARRANGEMENT FOR VACUUM SWITCHES

BACKGROUND OF THE INVENTION

The invention relates to a contact arrangement for vacuum switches with contacts which are movable relative to each other in their axial direction, and in which one of the contacts is designed as a pot contact whose sidewall partly surrounds the other contact. The inner height of the contacts is greater than the opening stroke of the contacts.

Upon opening the contacts of vacuum switches which are subject to a power load an arc is ignited during the separation of the contacts. The arc originates at the extreme end of the metallic point of contact and it spreads to fill the gap between the contacts. The metal vapor required for power conduction is generated in a multiplicity of cathode points which form on the negative electrode. In order to prevent precipitation of the erosion products (metal vapor and metal particles) on the insulator of the switch housing, the quenching chamber of larger-sized vacuum switches is generally provided with at least one so-called condensation screen. The screen, however, makes the switch more expensive and the quenching chamber correspondingly larger.

When currents up to about 10 KA are involved, a diffused metal vapor arc is obtained whose operating voltage is only about 20 to 50 V because of the low field strength in the plasma. The arc stress of such contacts, between which a diffused arc is burning, is therefore relatively low during the quenching process. The task of switching tubes for relatively low switching capacities can therefore be performed by disc contacts with a flat or slightly curved contact gaps. Also, the metal vapor is predominantly emitted in radial direction to the contact surface and the erosion products reach the quenching chamber housing via the shortest route. These erosion products deposit in part in a relatively narrow, annular wall zone concentrically surrounding the gap between the open contacts. Consequently, the thermal stress of this zone is correspondingly high. With increasing thickness of the precipitation layer there is the danger that parts of the layer will detach due to thermal stresses rendering the vacuum switch unusuable. Another portion of the metal vapor escaping from the contact gap is reflected at least once by the housing wall and thus can also reach switch parts not in the direct metal vapor path.

It is known to design one of the two coaxially disposed contacts of vacuum switches with so-called axial field contacts as recessed contacts whose inner sidewall, expands conically towards the rim and overlaps the other contact whose outside also expands conically. The opening angle of the recessed contact is selected smaller than the opening angle of the other contact, resulting in an annular contact surface between the conical surface parts when the contacts are closed and in the ignition of an arc when the contacts are opened. This design is supposed to cause the arc to rotate in a radial plane between the conical surfaces through the action of magnetic force (German disclosure No. 29 25 189).

On the other hand, in a contact arrangement of the kind described at the outset with so-called flat contacts, the contact surfaces are formed in a plane, central area at the bottom of the recessed contact and at the free face of the other contact.

Such a known contact arrangement for vacuum switches contains recessed contacts where the sidewall of the one contact whose contact bottom serves as contact surface surrounds, at least in part, the other contact whose face forms the contact surface. The arc is driven by magnetic forces radially outward between the concentric sidewalls of the contacts of which mutually facing surfaces serve as burn-up areas (German disclosure No. 25 46 376). Accordingly, in these embodiments, the erosion products of the arc can spread almost unhindered into the switch housing.

SUMMARY OF THE INVENTION

It is an object of the invention to provide a vacuum switch for high switching frequencies and relatively low switching capacities in which a disadvantageous influence of the erosion products upon the switch characteristics is prevented. At the same time, the burn-up behavior of the switch should be improved and, furthermore, the switch should be of simple design and of small size.

Now, according to the invention, the problem posed is solved in this contact arrangement by the characteristic features of claim 1. In this embodiment of the contact arrangement the sidewall of the recessed contact forms a metal vapor guide ring which conducts at least a substantial part of the metal vapor to the free portion of the flat side of the condensation plate to let it condense there. The contact face facing the other contact may preferably be designed so as to form with the facing portion of the free surface of the other contact and the condensation plate a streamlined gap to guide the metal vapor. This guiding action is provided by cooperation of the recessed contact, or cup-shaped contact, and the opposite contact, or protruding contact, which includes a concentric condensation plate extending from the base of the protruding contact. The vapor discharge angle is preferably chosen so that even if a certain number of metal atoms are reflected once by the condensation plate, no insulating parts are reached by the metal vapor. This contact arrangement including the concentric condensation plate provides an effective and low cost vacuum switch.

In one special embodiment of the contact arrangement the condensation plate may also be provided with a groove structure.

Other features and advantages of the invention will be apparent from the following description of the preferred embodiments and from the claims.

For a full understanding of the present invention, reference should now be made to the following detailed description of the preferred embodiments of the invention and to the accompanying drawings.

DETAILED DESCRIPTION

Preferred embodiments of the invention will now be described with reference to the drawings.

Figure 1:
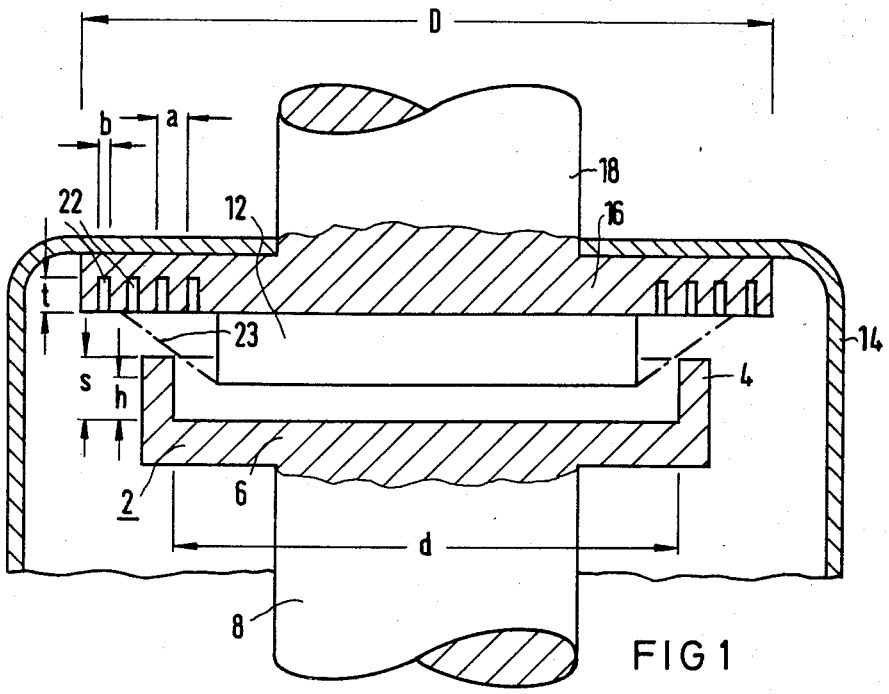
FIG. 1 shows, in section, a part of a vacuum switch with a contact arrangement according to the invention.

Reference numeral 2 in FIG. 1 designates a recessed contact with sidewall 4 forming a metal vapor guide ring. The free face of its bottom 6 serves as contact surface. By means of a current lead 8 the recessed contact 2 is movable relative to another contact 12 designed as disc-shaped flat contact, its free face forming the contact surface. Between the contact 12 and a preferably metallic portion of a housing 14 a disc-shaped condensation plate 16 is provided which consists of a good heat-conducting material, preferably copper or also a copper-chromium alloy whose diameter "D" is preferably much larger than the inside diameter "d" of the recessed contact 2. A current lead 18 for the contacts 12 is fastened to the condensation plate 16. But it may also be connected to the housing 14.

A particularly advantageous embodiment of the contact arrangement is obtained in that the condensation plate 16 is provided with grooves 22 at its free surface projecting beyond the contact 12, the groove width "b" being narrower than their mutual spacing "a" and also smaller than their depth "t". These grooves 22 increase the condensation area. In addition, they reduce the percentage of material reflected back into the quenching chamber because the material reflected inside a groove impinges the opposite groove wall. In particular, the groove structure may be such that the ratio of groove width "b" to groove spacing "a" is approximately 0.2 to 0.8.

A particularly advantageous effect on the metal vapor flow during the quenching process is obtained with sidewall 4 of the essentially flat recessed contact 2 whose height "s" is greater than the contact stroke "h" of the contact arrangement. This height "s" of the sidewall 4 may preferably be at least 1.5 times the contact stroke "h" and will generally not exceed twice the contact stroke by much so as not to hinder the metal vapor flow significantly. Due to the deflecting action of the sidewall 4 as metal vapor guide ring the plasma rays and metal vapors originating during the quenching process are conducted to the condensation plate 16 and thus can condense in contact vicinity. The diameter "D" of the condensation plate 16 can preferably be selected so that metal vapor emitted in a direction indicated by a dash-dotted line 23 still impinges the free portion of the flat side of the condensation plate 16. This direction follows from the connecting line between the outer edge of contact 12 and the inner edge of sidewall 4 of the recessed contact 2. An additional vapor screen for the protection of an insulator of housing 14, not shown in the FIG., is therefore not necessary.

Figure 2:
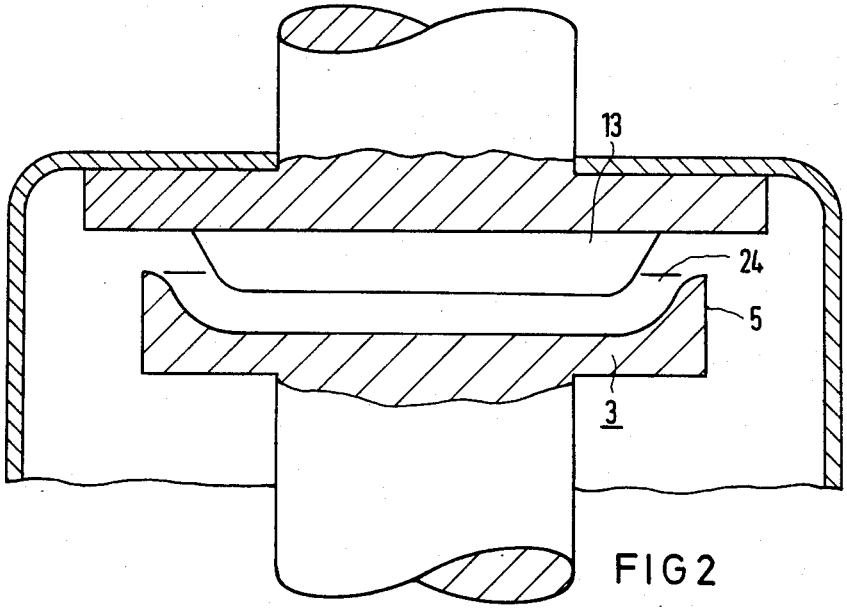
FIG. 2 illustrates a special shape of the contacts.

In another preferred embodiment of the contact arrangement according to FIG. 2 the contact arrangement contains a flat recessed contact 3 whose inside surface is rounded at the transition between the central (not crosshatched) contact surface and the rim of sidewall 5. The narrow side of a flat contact 13 is inclined so that a metal vapor guiding gap 24 with a nozzle profile favoring the discharge flow originates between the sidewall 5 of the recessed contact 3 and the flat contact 13. In this embodiment of the contact arrangement the metal vapor flow impediment by the metal vapor guide ring of the recessed contact 3 is particularly slight.

There has thus been shown and described a novel vacuum switch which fulfills all the objects and advantages sought therefor. Many changes, modifications, variations and other uses and applications of the subject invention will, however, become apparent to those skilled in the art after considering the specification and the accompanying drawings which disclose preferred embodiments thereof. All such changes, modifications, variations and other uses and applications which do not depart from the spirit and scope of the invention are deemed to be covered by the invention which is limited only by the claims which follow.

What is claimed is:

1. In a contact arrangement for a vacuum switch, the vacuum switch comprising contacts which are movable relative to each other in their axial direction, one of said contacts having a recessed area and designed as a recessed contact having a sidewall contiguous and extending above the periphery of the recessed area a distance defining a predetermined inner height and the predetermined inner height of the sidewall being greater than a contact stroke (h) of the contacts, said sidewall partly surrounding the other contact of said contacts when the vacuum switch is open, the other contact including a protruding contact portion which is adapted to extend into the base of the recessed area to make contact upon closure of the vacuum switch and a condensation plate extending outward from a base region of the protruding contact portion and located between said other contact and its current lead whose diameter (D) is greater than the inside diameter (d) of the recessed area of said recessed contact.

2. In a contact arrangement according to claim 1, wherein said condensation plate comprises part of a housing of said vacuum switch.

3. In a contact arrangement according to claim 1, further comprising grooves located at a free portion of the flat side of said condensation plate facing said recessed contact.

4. In a contact arrangement according to claim 2, further comprising grooves located at a free portion of the flat side of said condensation plate facing said recessed contact.

5. In a contact arrangement according to claim 3, wherein the width (b) of said grooves is narrower than their depth (t).

6. In a contact arrangement according to claim 4, wherein the width (b) of said grooves is narrower than their depth (t).

7. In a contact arrangement according to claim 3, wherein a groove width (b) of said grooves is less than the mutual spacing (a) of said grooves.

8. In a contact arrangement according to claim 4, wherein a groove width (b) of said grooves is less than the mutual spacing (a) of said grooves.

9. In a contact arrangement according to claim 1, wherein the inside height (s) of the sidewall of the recessed contact is at least 1.5 times the contact stroke (h) of said contact arrangement.

10. In a contact arrangement according to claim 3, wherein the inside height (s) of the sidewall of the recessed contact is at least 1.5 times the contact stroke (h) of said contact arrangement.

11. In a contact arrangement according to claim 1, wherein the inside height (s) of the sidewall of the recessed contact is at least 1.5 times the contact stroke (h) of said contact arrangement.

12. In a contact arrangement according to claim 1, wherein the surface of the sidewall of the recessed contact facing said other contact and a narrow side of said other contact are shaped so that the originating metal vapor guiding gap has a nozzle profile.

13. In a contact arrangement according to claim 3, wherein the surface of the sidewall of the recessed contact facing said other contact and a narrow side of said other contact are shaped so that the originating metal vapor guiding gap has a nozzle profile.

14. In a contact arrangement according to claim 4, wherein the surface of the sidewall of the recessed contact facing said other contact and a narrow side of said other contact are shaped so that the originating metal vapor guiding gap has a nozzle profile.

* * * * *